US006127429A

United States Patent [19]

Katusic et al.

[11] Patent Number: 6,127,429

[45] Date of Patent: Oct. 3, 2000

[54] ULTRASONIC ATOMIZATION FOR PRODUCTION OF AEROSOLS

[75] Inventors: Stipan Katusic, Kelkheim; Rainer Golchert, Darmstadt; Helmut Mangold, Rodenbach, all of Germany

[73] Assignee: Degussa-Huls AG, Frankfurt, Germany

[21] Appl. No.: 09/025,346

[22] Filed: Feb. 18, 1998

[30] Foreign Application Priority Data

Feb. 20, 1997 [DE] Germany ..... 197 06 698

[51] Int. Cl.[7] ..... B01F 3/04; B05B 17/06

[52] U.S. Cl. ..... 516/6; 239/4; 239/102.2; 118/303

[58] Field of Search ..... 516/6; 239/4, 102.2; 118/303

[56] References Cited

U.S. PATENT DOCUMENTS

| | | | |
|---|---|---|---|
| 3,901,443 | 8/1975 | Mitsui | 239/102.2 |
| 4,031,171 | 6/1977 | Asao et al. | 239/102.2 |
| 4,410,139 | 10/1983 | Nishikawa | 239/102.2 |
| 4,656,963 | 4/1987 | Yonehara | 118/326 |
| 4,731,204 | 3/1988 | Noma et al. | 239/102.2 |
| 4,746,466 | 5/1988 | Takahashi | 261/30 |
| 4,776,990 | 10/1988 | Verity | 239/102.2 |
| 5,110,618 | 5/1992 | Faust | 427/482 |
| 5,300,260 | 4/1994 | Keshet et al. | 239/102.2 |
| 5,306,981 | 4/1994 | Martel | 310/348 |
| 5,361,989 | 11/1994 | Merchat | 239/102.2 |

FOREIGN PATENT DOCUMENTS

| | | |
|---|---|---|
| 0 158 038 | 10/1985 | European Pat. Off. . |
| 0 213 056 | 3/1987 | European Pat. Off. . |
| 0 411 499 | 2/1991 | European Pat. Off. . |
| 0 571 316 | 11/1993 | European Pat. Off. . |
| 83 16 307 | 6/1983 | Germany . |
| 37 06 593 | 9/1987 | Germany . |
| 43 05 713 | 9/1994 | Germany . |

OTHER PUBLICATIONS

Lehfeldt, "Ultraschall", Vogel–Verlag, Wurzburg (1973) Month unknown pp. 105–106.

Kuttruff, "Physik und Technik des Ultraschalls", S. Hirzel Verlag, Stuttgart 1988, Month unknown pp. 390–391.

*Primary Examiner*—Richard D. Lovering
*Assistant Examiner*—Daniel S. Metzmaier
*Attorney, Agent, or Firm*—Pillsbury Madison & Sutro LLP

[57] ABSTRACT

A method and a device for producing aerosols highly charged with liquid phase and with small droplets by using ultrasonic transmitters in which an ultrasonic transmitter oscillates in a plane parallel to, or in an inclined plane of 1° to 20° relative to, the surface level of the liquid. When several transmitters are used in a compact unit, each transmitter is seated in a recess and each individual transmitter oscillates in a plane parallel to, or in a plane inclined at 1° to 20° relative to, the plane of the surface level of the liquid. The aerosols can be used as raw material for pyrolysis, coating, the doping of substances and in medicine.

4 Claims, 6 Drawing Sheets

ULTRASONIC ATOMIZATION FOR PRODUCTION OF AEROSOLS

CROSS REFERENCE TO RELATED APPLICATION

This application claims priority from German Application No. 197 06 698.4 filed Feb. 20, 1997.

FIELD OF THE INVENTION

The invention is related to a method and a device for producing aerosols, especially aerosols of saline solutions, by ultrasonic atomization.

BACKGROUND OF THE INVENTION

The production of aerosols, especially aerosols of solutions containing salt, in a gaseous phase, has problems similar to the problems associated with the production of pyrolytic or pyrolytically decomposable materials, e.g. in spray pyrolysis.

As is known, aerosols are produced by means of jets or by the ultrasonic atomization of appropriate saline solutions. An ultrasonic transmitter is used.

The known methods have the disadvantage that the content of saline solution in the fluid carrier medium, which is usually a gas, can only be varied within a narrow band without decisively influencing the droplet spectrum of the aerosol.

However, it is required for certain areas of application to vary the concentration of the solid or the liquid in the gas with an unchanged droplet spectrum of the aerosol over a broad range. In particular, there is a problem to be overcome in avoiding a high loading with foreign gas, which is tantamount to a low concentration of solid or fluid phases in the gas flow.

The production of aerosols with high concentrations of saline solutions in the gaseous phase (up to approximately 800 g/Nm$^3$) and at the same time with a droplet spectrum with a value of d50 in a range of approximately 6 $\mu$m, that is, relatively small droplets, was not industrially practicable in the past.

SUMMARY OF THE INVENTION

The purpose of the invention is to develop a method and a device for the production of aerosols with a high concentration of a saline solution in the gaseous phase assuring at the same time a droplet spectrum with the smallest possible droplet diameters.

The invention is a method of producing aerosols highly charged in a liquid phase and with small droplets by means of ultrasonic transmitters in which an ultrasonic transmitter oscillates in a plane parallel to, or in an inclined plane of 1° to 20°, preferably between 5° and 8° relative to, the plane of the liquid. If several transmitters are used in a compact unit, the transmitters are seated in a recess and each individual transmitter oscillates in a plane parallel to, or in a plane inclined between 1° and 20°, preferably between 5° and 8° relative to, the plane of the liquid.

Any known aqueous solutions of salts or suspensions of salts in water can be used as the liquid.

The concentration of the salts in these solutions or suspensions can be from 0.0001% to 20% by weight.

In a preferred embodiment of the invention the concentration of the salts can be 4% to 6% by weight, preferably 5% by weight.

The invention further includes a device for producing aerosols highly charged in a liquid phase and with small droplets which is characterized in that an ultrasonic transmitter oscillates in a plane parallel to, or in an inclined plane of 1° to 20°, preferably between 5° and 8° relative to, the plane of the liquid. If several transmitters are used in a compact unit, the transmitters are seated in a recess. Each individual transmitter oscillates in a plane parallel to, or in a plane inclined between 1° and 20°, preferably between 5° and 8° relative to, the plane of the liquid. The level of the liquid is above the ultrasonic transmitters and the level of which liquid can be controlled via the plane of oscillation. A carrier gas, with which the aerosol produced can be discharged, can be introduced optimally via or above the liquid.

Further, an aerosol produced in accordance with the method of the invention contains a charge in the gaseous phase of more than 100 g/Nm$^3$ liquid and the d90 values of the droplet spectrum (volumetric value) are below 30 $\mu$m, between 1 $\mu$m and 30 $\mu$m, preferably between 1 $\mu$m and 10 $\mu$m.

Additionally, a method of using the aerosols produced in accordance with the method of the invention is as raw material for pyrolysis, coating, doping of substances and in medicine.

DETAILED DESCRIPTION OF THE INVENTION

The invention will be described with reference to the Figures, in which like numerals represent like parts.

The production of an aerosol with commercial ultrasonic transmitters is known.

Figure 1:
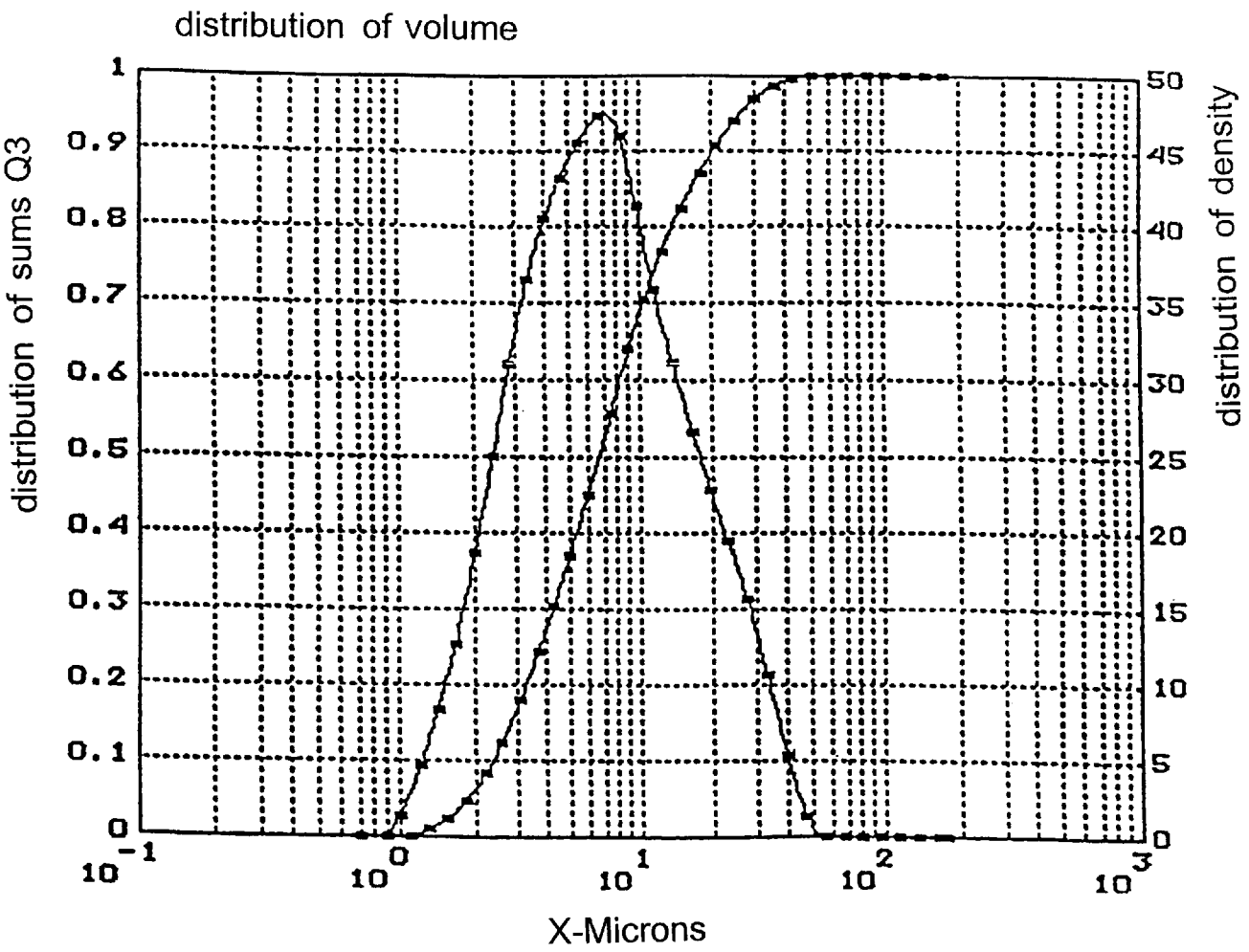
FIG. 1 is a graph showing a droplet spectrum of atomized water.

Such a commercial transmitter, made by the Panasonic Company (type EFEHEV1R7M52, 1.63 MHz) has, for atomization of distilled water (at 50° C.) and a current of carrier gas of 1.0 Nm$^3$/h placed above it, a droplet spectrum of atomized water as shown in FIG. 1 and Table 1.

TABLE 1

(corresponding to FIG. 1)

| x/mym | Q3 (%) | x/mym | Q3(%) | x/mym | Q3(%) | x/mym | Q3(%) |
|---|---|---|---|---|---|---|---|
| | | 3.10 | 17.89 | 12.50 | 76.61 | 51.00 | 100.00 |
| 0.90 | 0.00 | 3.70 | 24.33 | 15.00 | 82.27 | 61.00 | 100.00 |
| 1.10 | 0.28 | 4.30 | 30.40 | 18.00 | 87.13 | 73.00 | 100.00 |
| 1.30 | 1.06 | 5.00 | 36.88 | 21.00 | 90.63 | 87.00 | 100.00 |

TABLE 1-continued (corresponding to FIG. 1)

| x/mym | Q3 (%) | x/mym | Q3(%) | x/mym | Q3(%) | x/mym | Q3(%) |
|---|---|---|---|---|---|---|---|
| 1.50 | 2.24 | 6.00 | 45.15 | 25.00 | 94.01 | 103.00 | 100.00 |
| 1.80 | 4.54 | 7.50 | 55.66 | 30.00 | 96.86 | 123.00 | 100.00 |
| 2.20 | 8.27 | 9.00 | 64.03 | 36.00 | 98.80 | 147.00 | 100.00 |
| 2.60 | 12.45 | 10.50 | 70.39 | 43.00 | 99.76 | 175.00 | 100.00 |
| x10 =2.37 mym x50 = 6.69 mym x90 = 20.46 | | | | | | | |
| x5 = 1.85 mym x30 = 4.26 mym x84 = 16.07 | | | | | | | |

The d90 value (90% of the droplets, volumetric portion) is 20.46 $\mu$m, the d50 value 6.69 $\mu$m.

The droplet spectra are determined with a "Helos" laser diffraction spectrometer made by The Sympatic Company.

Figure 2B:
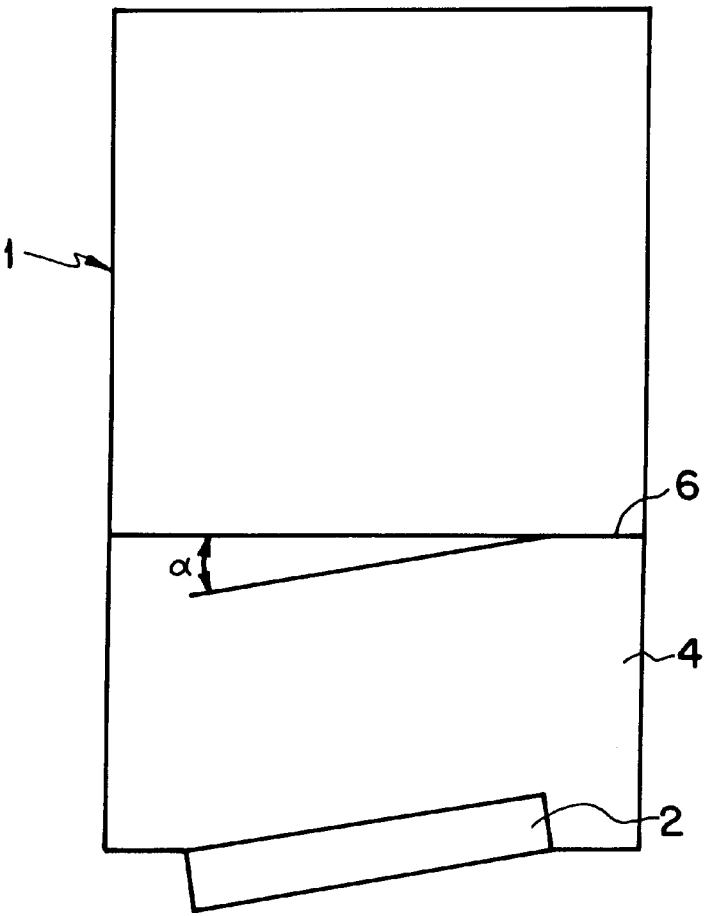
FIGS. 2A and 2B are schematic arrangements showing the plane of oscillation of an ultrasonic transmitter according to the invention.
Figure 2A:
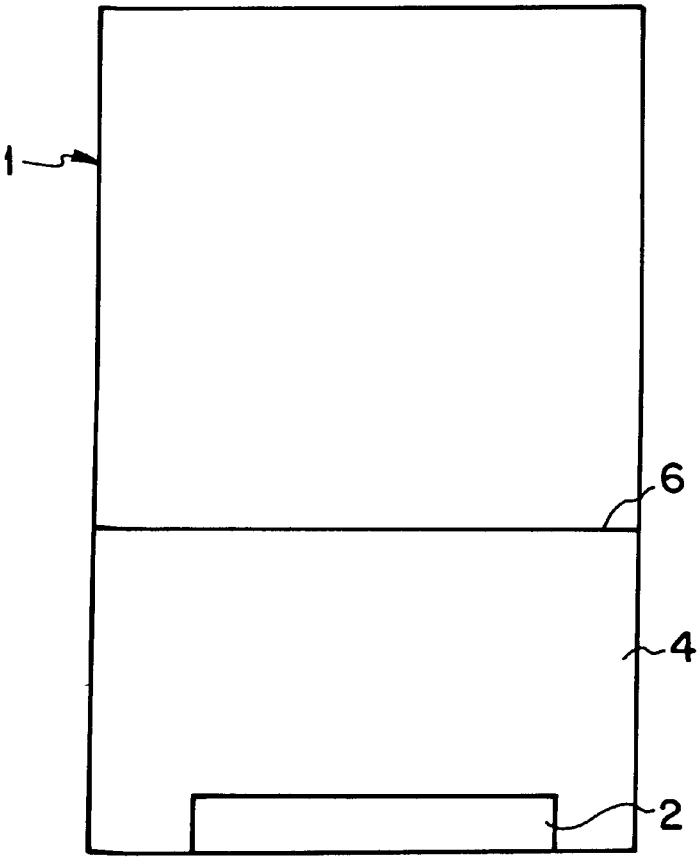

The production of a droplet spectrum with a lower d50 value can take place in accordance with the invention if the installation of the ultrasonic transmitter is not parallel to the surface of the liquid but rather when the plane of oscillation of the ultrasonic transmitter is at an angle of 1° to 20°, preferably from 5° to 8°, to the plane of the liquid surface. This arrangement is schematically shown in FIGS. 2A and 2B. FIG. 2A shows unit 1 having planar ultrasonic transmitter 2 submerged in liquid 4 having a surface level 6. FIG. 2B shows a transmitter 2 disposed at an angle of inclination $\alpha$ of between 1° and 20° to the surface level 6 of liquid 4 in unit 1.

Figure 3:
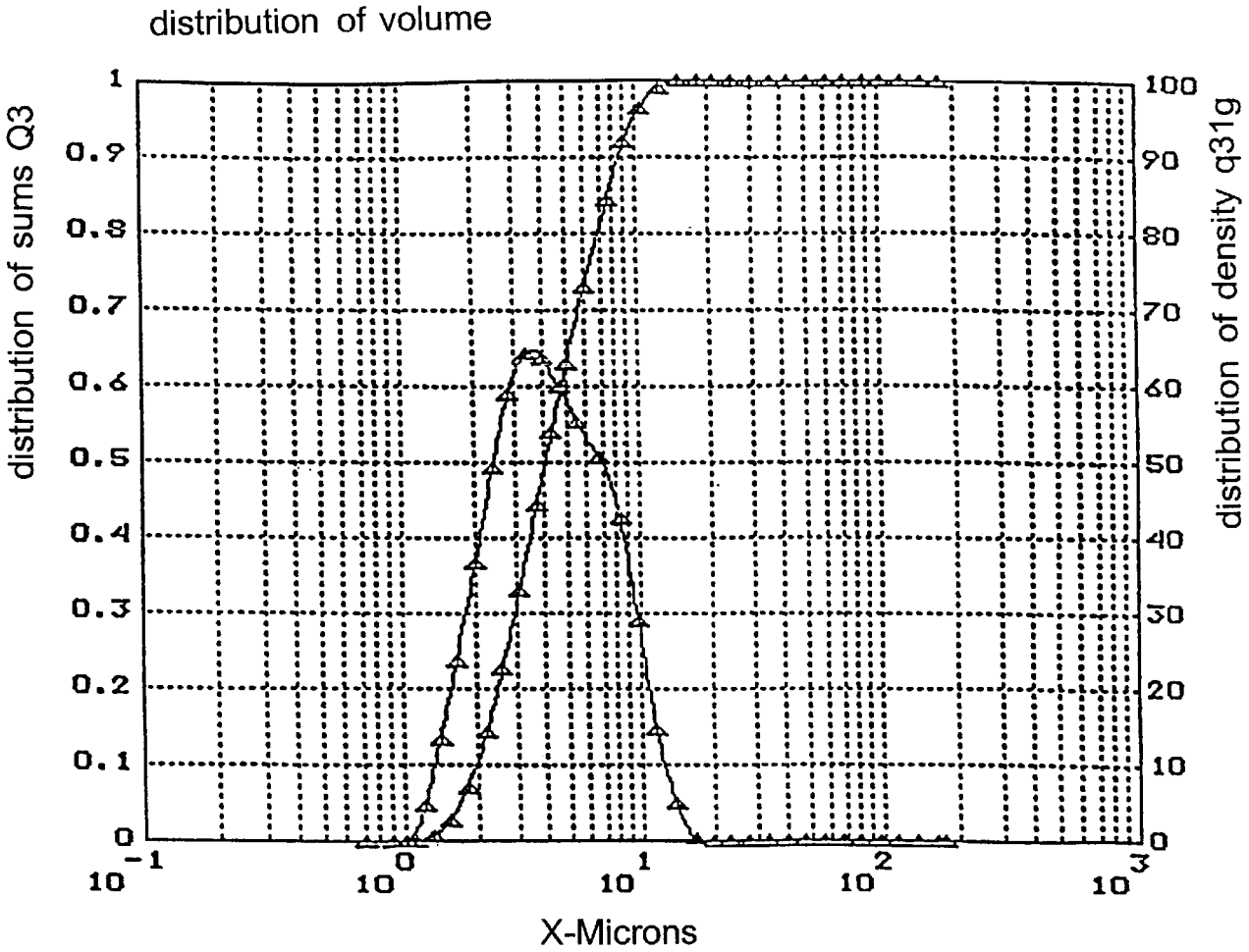
FIG. 3 is a graph showing a droplet spectrum of atomized water obtained using a device of the invention.

The droplet spectrum attained with this installation method (at an amount of carrier air of 0.9 $Nm^3/h$) is shown in FIG. 3 and Table 2.

TABLE 2

(corresponding to FIG. 3)

| x/mym | Q3 (%) | x/mym | Q3(%) | x/mym | Q3(%) | x/mym | Q3(%) |
|---|---|---|---|---|---|---|---|
| | | 3.10 | 32.96 | 12.50 | 99.01 | 51.00 | 100.00 |
| 0.90 | 0.00 | 3.70 | 44.30 | 15.00 | 99.94 | 61.00 | 100.00 |
| 1.10 | 0.00 | 4.30 | 53.86 | 18.00 | 100.00 | 73.00 | 100.00 |
| 1.30 | 0.78 | 5.00 | 62.87 | 21.00 | 100.00 | 87.00 | 100.00 |
| 1.50 | 2.70 | 6.00 | 72.69 | 25.00 | 100.00 | 103.00 | 100.00 |
| 1.80 | 7.00 | 7.50 | 84.25 | 30.00 | 100.00 | 123.00 | 100.00 |
| 2.20 | 14.35 | 9.00 | 91.99 | 36.00 | 100.00 | 147.00 | 100.00 |
| 2.60 | 22.59 | 10.50 | 96.46 | 43.00 | 100.00 | 175.00 | 100.00 |
| x10 = 1.96 mym x50 = 4.06 mym x90 = 8.61 | | | | | | | |
| x5 = 1.66 mym x30 = 2.96 mym x84 = 7.47 | | | | | | | |

Table 3 shows the effect of inclined installation of the ultrasonic transmitter on the droplet spectrum. The measured droplet diameters are indicated.

TABLE 3

Effect of inclined installation on liquid droplet size

| Ultrasonic transmitter | d10 $\mu$m | d50 $\mu$m | d90 $\mu$m |
|---|---|---|---|
| planar installation | 2.37 | 6.69 | 20.46 |
| 7 degrees inclination | 1.96 | 4.06 | 8.61 |

d = droplet diameter.

In order to achieve the highest possible charge of the gaseous phase with saline solution it would be conceivable to connect several ultrasonic transmitters together in an atomizing unit.

Such connecting together of several transmitters in one compact apparatus results in a mutual influencing of the transmitters (and in a reduced atomization performance) as well as in a possible mutual destruction of the transmitters.

Figure 4:
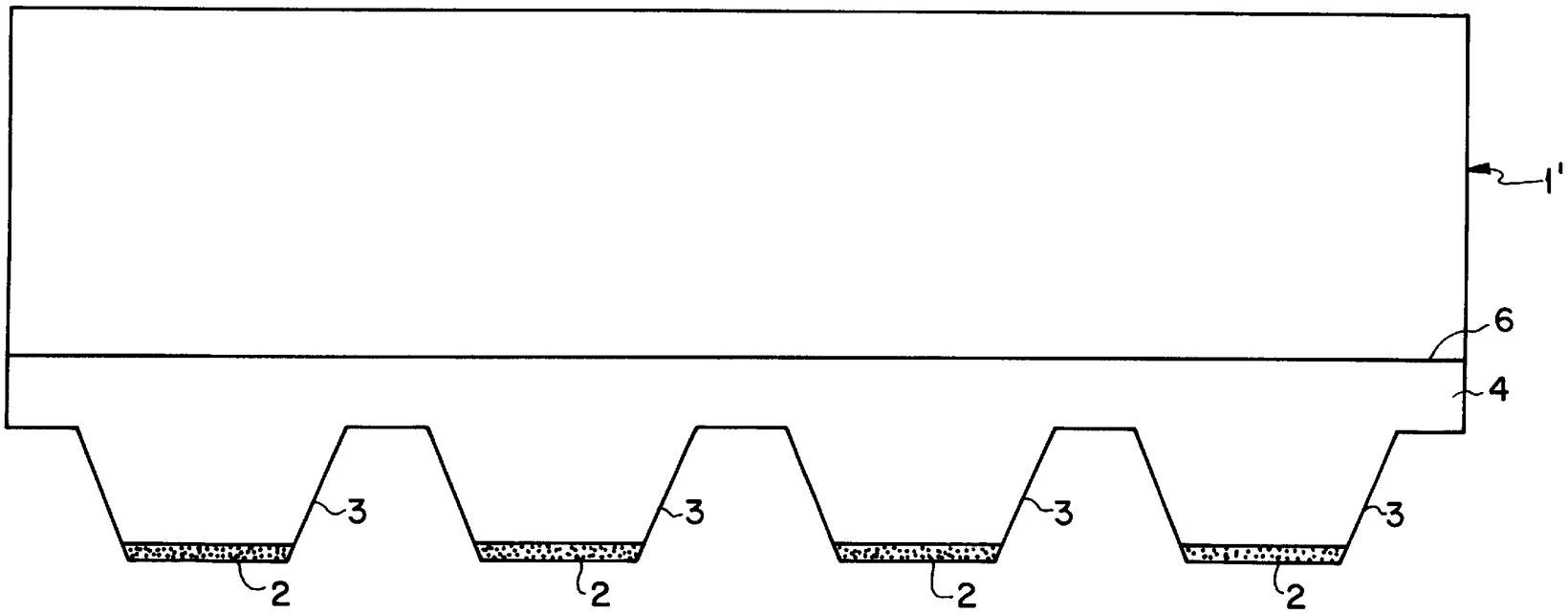
FIG. 4 schematically shows transmitter installation in recesses.

The problem of connecting together the ultrasonic transmitters without loss of performance and mutual destruction is solved by the invention in that the transmitters are seated in a recess, as is schematically shown in FIG. 4. This makes it possible to operate several transmitters at the same time without any such disadvantages occurring. FIG. 4 shows unit 1' having ultrasonic transmitters 2 each located in a recess 3, submerged in liquid 4 having a surface level 6.

If the ultrasonic transmitters seated in the recess are also inclined in their axis of oscillation relative to the surface of the liquid, namely, between 1° and 20° but preferably between 5° and 8°, then, as was surprisingly found, atomization performance of the ultrasonic transmitters which is better than that in a planar installation is achieved. This is shown in Table 4, which compares the atomization performance of several ultrasonic transmitters connected together, seated in a recess, in a planar or in an inclined installation.

TABLE 4

Influence of the plane of the ultrasonic transmitters on the atomization performance.

| | 7° arrangement atomization performance (g/h) | | Plane arrangement atomization performance (g/h) | |
|---|---|---|---|---|
| No. of transmitters | total | per transmitter | total | per transmitter |
| 3 | 424 | 141.3 | 215 | 71.7 |
| 4 | 525 | 131.3 | 290 | 72.5 |
| 5 | 495 | 99 | 310 | 62 |

Water temperature 30° C.
Carrier current: Air 1 $Nm^3/h$.
Carrier gas temperature 25° C.

Figure 5:
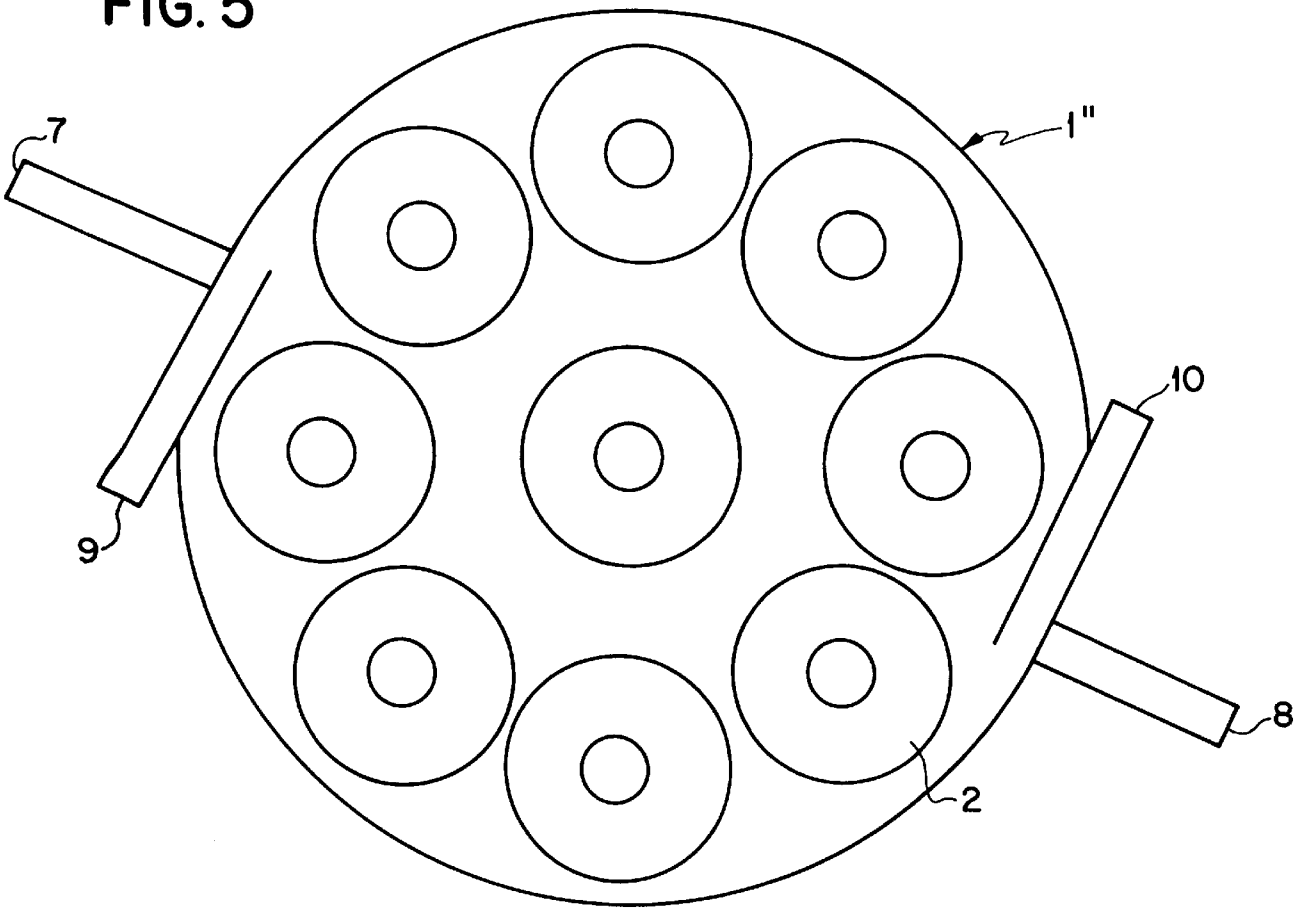
FIG. 5 shows, schematically, a top view taken from inside a light according to the invention for producing highly charged aerosols.
Figure 6:
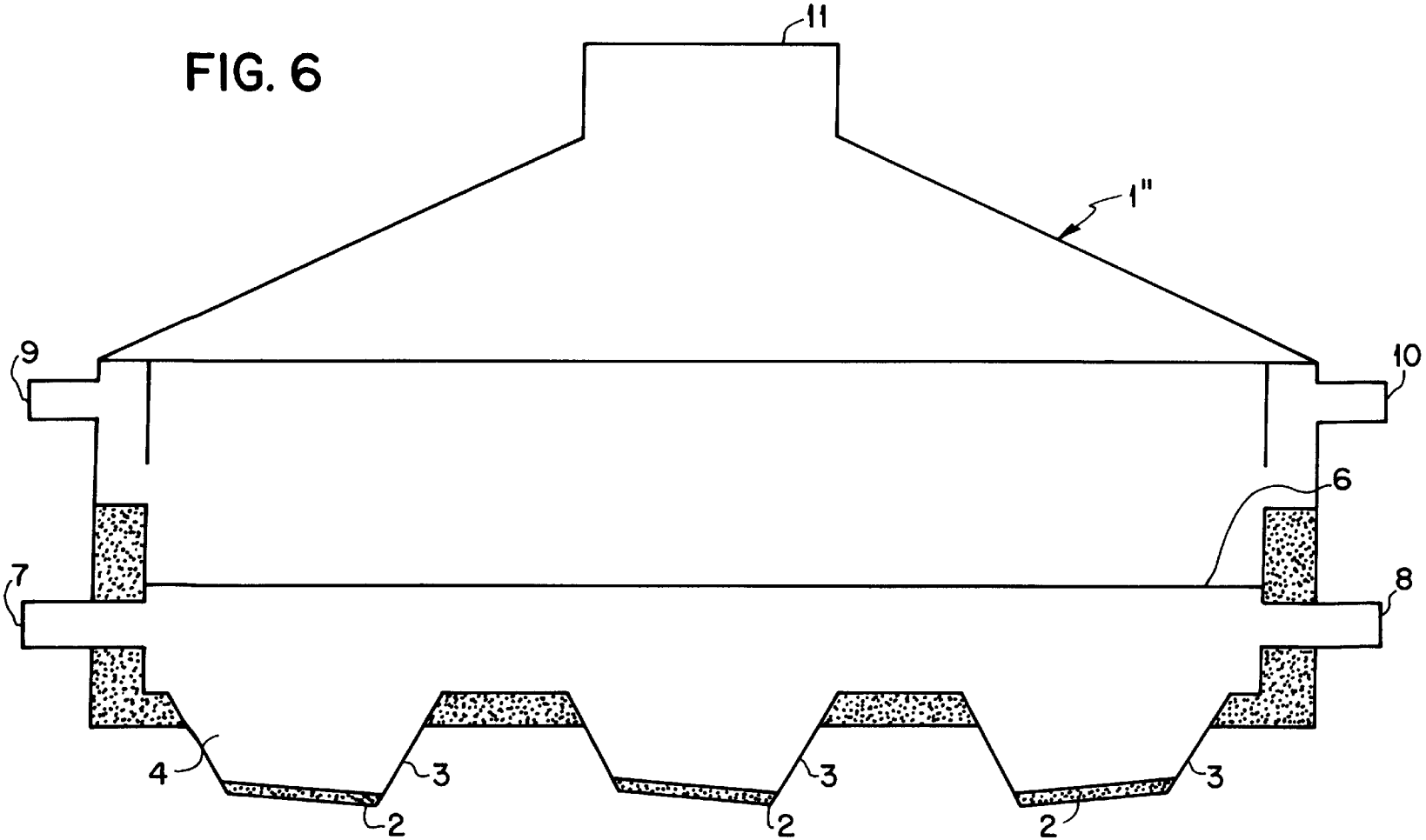
FIG. 6 shows, schematically, a sectional view of a unit of FIG. 5 for producing highly charged aerosols.

FIGS. 5 and 6 show apparatus for producing highly charged aerosols with small droplet diameters.

The apparatus includes nine ultrasonic transmitters 2 arranged in unit 1" as in FIGS. 5 and 6. Each of these ultrasonic transmitters is seated in a recess 3 in order to avoid mutual influence or destruction (FIG. 6). A constant liquid filling level above the transmitters is assured by appropriately positions liquid inlet 7 and liquid overflow outlet 8. The ultrasonic transmitters 2 seated in the recesses 3 are inclined with their oscillating surface at 7° relative to the surface plane 6 of the liquid 4. The lowest position of the particular outer transmitters is located toward the middle of the circle.

Two gas pipelines 9, 10 into which the carrier gas is input are located above the liquid.

The aerosol highly charged with liquids exits upward out of the large opening 11.

An advantage of the method and apparatus of the invention is the production of aerosols which are highly charged (with liquid droplets), which highly charged aerosol exhibits a small droplet size.

Aerosols produced in accordance with these methods can be used, for example, as raw material for a subsequent pyrolysis, for coatings, for the doping of substances and in medicine.

What is claimed is:

1. A method for producing small highly charged liquid phase aerosol droplets, comprising:

arranging a plurality of ultrasonic transmitters in a compact unit, such that each ultrasonic transmitter is individually seated in a recess located in a floor portion of a tank, wherein said tank holds a liquid from which the aerosol droplets are formed, and wherein each of said ultrasonic transmitters is positioned in said recess so as to be parallel to a surface level of the liquid in said tank or inclined at an angle of from 1° to 20°, relative to a surface level of the liquid in said tank;

oscillating each said ultrasonic transmitter in a plane parallel to, or inclined at an angle of from 1° to 20°, relative to a surface level of the liquid in said tank;

thereby producing said small highly charged liquid phase aerosol droplets.

2. A device for producing small highly charged liquid phase aerosol droplets according to the method of claim 1 comprising:

a tank for holding a liquid phase from which the aerosol droplets are formed, wherein said tank comprises a floor having recessed portions therein, wherein each recessed portion houses an ultrasonic transmitter, and further wherein said ultrasonic transmitters are arranged in a compact unit;

wherein each ultrasonic transmitter is positioned in a said recessed portion in a plane parallel to a surface level of the liquid in said tank or inclined at an angle of from 1° to 20°, relative to the surface level of the liquid in said tank, and wherein each individual transmitter oscillates in a plane parallel to or inclined at an angle of from 1° to 20°, relative to the surface level of the liquid from which the liquid phase of the aerosol droplets is formed;

wherein when the surface level of the liquid is located above the one or more ultrasonic transmitters, the surface level of the liquid is controlled via the plane of oscillation, and a carrier gas is introduced above the surface level of the liquid to discharge said small highly charged liquid phase aerosol droplets.

3. The method according to claim 1, wherein the plurality of ultrasonic transmitters are oscillated at an inclined angle of from 5° to 8°, relative to a surface level of the liquid in said tank.

4. The device according to claim 2, wherein the plurality of ultrasonic transmitters are oscillated at an inclined angle of from 5° to 8°, relative to a surface level of the liquid in said tank.

* * * * *